US011193745B1

(12) United States Patent
Campbell et al.

(10) Patent No.: US 11,193,745 B1
(45) Date of Patent: Dec. 7, 2021

(54) SINGLE-POINT MUNITION ARMING INTERFACE

(71) Applicant: U.S. Government as Represented by the Secretary of the Army, Dover, NJ (US)

(72) Inventors: Daniel Campbell, Morristown, NJ (US); Geraldine Reilly, Hackettstown, NJ (US)

(73) Assignee: The United States of America as Represented bv the Secretary of the Army, Washington, DC (US)

( * ) Notice: Subject to any disclaimer, the term of this patent is extended or adjusted under 35 U.S.C. 154(b) by 0 days.

(21) Appl. No.: 16/869,730

(22) Filed: May 8, 2020

Related U.S. Application Data

(60) Provisional application No. 62/845,530, filed on May 9, 2019.

(51) Int. Cl.

| | |
|---|---|
| ***F42C 15/40*** | (2006.01) |
| ***F42C 15/196*** | (2006.01) |
| ***F42B 23/24*** | (2006.01) |
| *F42C 15/184* | (2006.01) |

(52) U.S. Cl.
CPC ..... *F42C 15/40* (2013.01); *F42C 15/196* (2013.01); *F42B 23/24* (2013.01); *F42C 15/184* (2013.01)

(58) Field of Classification Search
CPC ..... F42C 15/18; F42C 15/184; F42C 15/188; F42C 15/192; F42C 15/196; F42C 15/40; F42B 8/28; F42B 3/103; F42B 23/24; F41A 19/68
See application file for complete search history.

(56) References Cited

U.S. PATENT DOCUMENTS

| | | | | |
|---|---|---|---|---|
| 3,439,610 | A * | 4/1969 | Myers | F42B 10/56 102/383 |
| 3,662,607 | A * | 5/1972 | Milanowski | F42C 15/22 74/2 |
| 3,985,075 | A * | 10/1976 | Kulesza | F42C 7/00 102/429 |
| 4,296,669 | A | 10/1981 | Debona | |
| 4,380,197 | A * | 4/1983 | Eaton | F42C 15/40 102/228 |
| 4,466,332 | A | 8/1984 | Van Sloun | |
| 4,604,939 | A | 8/1986 | Hoffmeister | |
| 4,926,750 | A * | 5/1990 | Van Sloun | F42C 15/20 102/261 |

(Continued)

*Primary Examiner* — Joshua T Semick
(74) *Attorney, Agent, or Firm* — John P. DiScala

(57) ABSTRACT

A single-point munition arming interface provides a more efficient approach to arming a canister-based munition. The single-point munition arming interface interfaces with electrically-initiated canister-based munitions. The arming interface locks and arms munitions in a baseplate system before initiation. The single-point munition arming interface includes a feature for removing the first safety in the munitions safe and arm device which is actuated upon insertion of the munition into the interface. The second step in the procedure is a user action which simultaneously locks the munition to the interface and completes the arming sequence by using a single mechanism to achieve both essential motions. The arming interface can be mechanically or electrically actuated allowing for remote activation which increases operator safety.

19 Claims, 12 Drawing Sheets

(56) References Cited

U.S. PATENT DOCUMENTS

| | | | | |
|---|---|---|---|---|
| 6,481,327 | B1 * | 11/2002 | Klukas | F42B 8/28 89/1.51 |
| 6,799,517 | B1 | 10/2004 | Cahill | |
| 7,237,468 | B2 * | 7/2007 | Laine | F41A 27/28 89/37.05 |
| 7,464,648 | B2 * | 12/2008 | Teowee | F42C 15/188 102/254 |
| 8,893,604 | B1 | 11/2014 | Gray | |
| 8,910,557 | B2 | 12/2014 | Cox | |
| 9,228,803 | B2 * | 1/2016 | Edge | F42C 11/065 |
| 9,739,577 | B2 * | 8/2017 | Zhang | F42B 3/103 |
| 10,330,450 | B1 | 6/2019 | Kokodis | |
| 10,718,600 | B2 * | 7/2020 | Tamar | F42C 15/40 |
| 10,859,359 | B1 * | 12/2020 | Shaw | F42C 15/188 |
| 2003/0051597 | A1 | 3/2003 | O'Dwyer | |
| 2004/0244628 | A1 | 12/2004 | O'Dwyer | |
| 2005/0022657 | A1 | 2/2005 | O'Dwyer | |

* cited by examiner

SINGLE-POINT MUNITION ARMING INTERFACE

CROSS-REFERENCE TO RELATED APPLICATIONS

This application claims the benefit under 35 USC 119(e) of U.S. provisional patent application 62/845,530 filed May 9, 2019.

STATEMENT OF GOVERNMENT INTEREST

The inventions described herein may be manufactured, used and licensed by or for the United States Government.

FIELD OF THE INVENTION

The invention relates in general to munitions and in particular to arming mechanisms for munitions.

BACKGROUND OF THE INVENTION

Mine dispensers have been traditionally mounted on ground or air vehicles. Given this, the arming interfaces for munition canisters are designed for use on those platforms. Typically, the munition canisters are traditionally armed in a depot or base setting. Multiple munition canisters are inserted into the arming device at one time. A multiple step arming process is then performed to arm the munitions within the munition canister. The process involves a two lever device in which each lever must be pulled in the correct sequence.

While this two lever process and mechanism is suitable for conventional vehicular dispensers, it is not suitable for new hand emplaced dispensers, such as the Standoff Activated Volcano Obstacle (SAVO) baseplate in use by the United States Army. The two lever arming device for locking and arming canister-based munitions is a cumbersome, inefficient and impractical method for smaller hand emplaced dispensers. In particular, the process is overly complex for soldiers under duress. Additionally, the existing levers are impractical as they may pose a danger if soldiers use them as handles. This could potentially result in damage to the system. Finally, the existing two lever solutions require extra components which adds complexity to a system that is designed to be exposed to the external environment through many weather environments and for long emplacement durations when compared to vehicular applications.

A need exists for an apparatus and method for arming munitions within hand emplaced dispensers.

SUMMARY OF INVENTION

One aspect of the invention is a single-point munition arming interface for safeing and arming a munition canister. The single-point munition arming interface comprises a mounting bracket, an electrical interface, a retaining arm, a center rod, an arming lever, an arming plate, a locking lug and a lug spring. The mounting bracket has a first mounting bracket arm and a second mounting bracket arm and defines an opening for receiving a breech of a munition canister. The electrical interface is mounted through the mounting bracket for making an electrical connection with the munition canister. The retaining arm is for interfacing with a munition plunger of a canister safe and arm device. The center rod is vertically supported by but axially unrestrained by the first mounting bracket arm and the second mounting bracket arm. The arming lever is hingedly connected to a proximate end of the center rod such that a rotation of the arming lever causes the center rod to translate axially. The arming plate further comprising a base, a first arming plate arm and a second arming plate arm and positioned between the first arm and the second arm of the mounting bracket with the center rod extending through a first arming plate arm and a second arming plate arm. The locking lug is sized and dimensioned to interface with a canister locking key and positioned slidably on the center rod between the first arming plate arm and the second arming plate arm. The lug spring surrounds the center rod between the locking lug and the second arming plate arm. A rotation of the arming lever causes the center rod to translate axially toward the arming lever thereby simultaneously causing the arming plate and the locking lug to translate axially toward the arming lever and the locking lug interacting with a locking key on a canister and the arming mechanism interacting with a slider of the canister safe and arm device.

Another aspect of the invention is single-point munition arming interface for safeing and arming a munition canister. The single-point munition arming interface comprises a mounting bracket, an electrical interface, a retaining arm and a locking mechanism and arming mechanism. The mounting bracket defines an opening for receiving a breech of a munition canister. The electrical interface is mounted through the mounting bracket for making an electrical connection with the munition canister. The retaining arm interfaces with a munition plunger of a canister safe and arm device. The locking mechanism and arming mechanism is simultaneously operated by a common rotating lever. The locking mechanism interacts with a locking key on a canister and the arming mechanism interacts with a slider of the canister safe and arm device.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
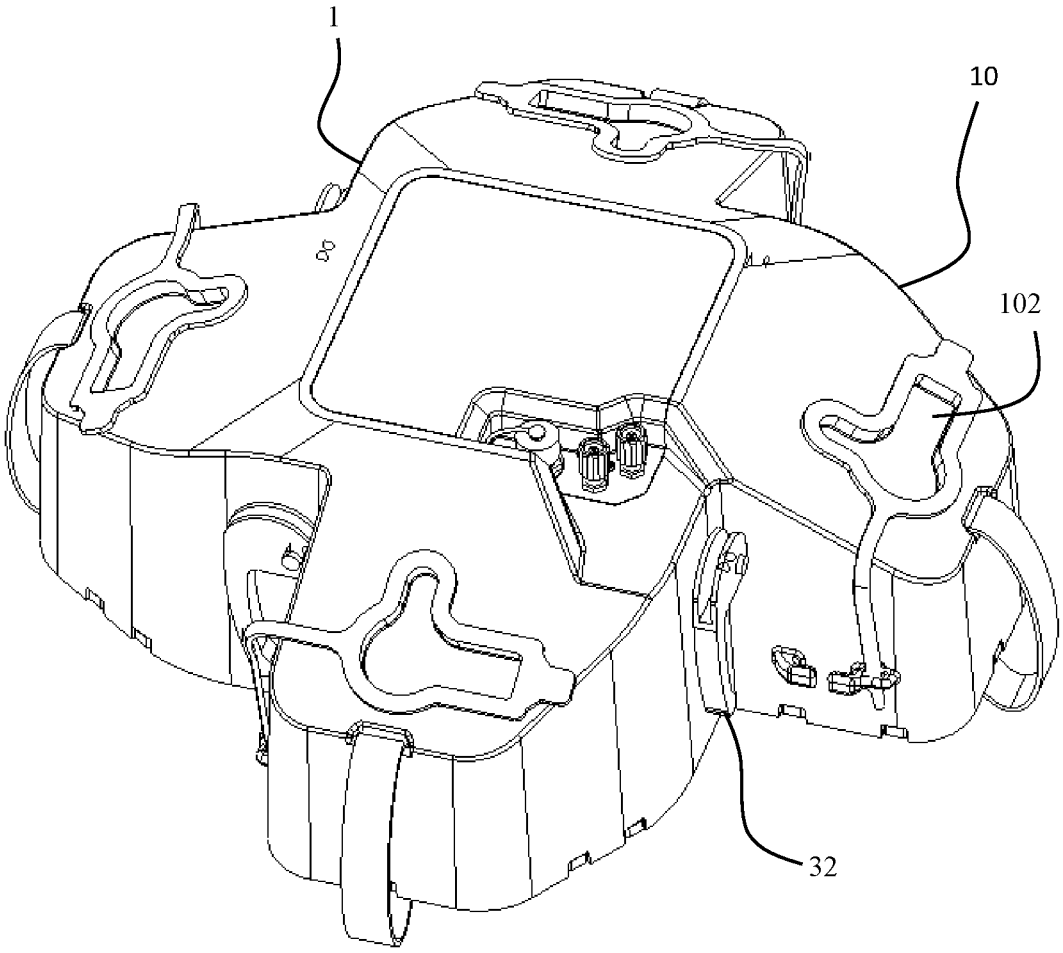
FIG. 1 shows a SAVO baseplate, according to an illustrative embodiment.

A single-point munition arming interface provides a safer and more efficient approach to arming a canister-based munition. The single-point munition arming interface is particularly suited for use with free standing munition baseplates, such as hand-emplaced munition baseplates. The single-point munition arming interface interfaces with an electrically-initiated canister-based munition to lock and arm the munition in a baseplate system before initiation.

The arming interface provides an efficient arming sequence while still being compliant with applicable arming standards for hand emplaced munitions, including MIL-STD-1911. As such, the arming interface requires two manual user actions which are sequential, discrete and non-subvertible for arming a munition system. The single-point munition arming interface includes a feature for removing the first safety in a munition's safe and arm device which is actuated upon insertion of the munition into the interface. A subsequent user action to a single mechanism both simultaneously locks the munition to the interface and completes the arming sequence.

Advantageously, the single-point munition arming interface reduces the complexity of the arming system thereby creating a safer process for soldiers under duress. This is especially advantageous for soldiers arming canister-based munitions in a hand emplaced baseplate, such as the Standoff Activated Volcano Obstacle (SAVO) hand emplaced baseplate. In addition, the arming interface can be mechanically or electrically actuated thereby allowing for remote activation which increases operator safety.

Finally, if the munition canister is not initiated, the arming operation is reversible to disarm the munitions. The user simply operates the single-point munition arming interface in the opposite direction to bring the device back to a safe state.

The single-point munition arming interface is described throughout this specification in the context of a canister based munition for illustrative purposes. In particular, the single-point munition arming interface is shown and described as an integrated component of a baseplate in a SAVO scalable mine deployment system as described in co-owned U.S. Pat. No. 10,330,450 entitled Scalable Mine Deployment System and issued on Jun. 25, 2019. The SAVO scalable mine deployment system described in this specification is described in the context of employing a munition canister of a type similar in size and operation as the munition canisters employed in the M87/M87A1 Volcano Multiple Delivery Mine system.

However, the single-point munition arming interface is not limited to use in a single platform, such as the SAVO scalable mine deployment system, with a single munition type, such as canister-based munitions, or a single munition, such as M87/M87A1 Volcano Multiple Delivery Mine system munition canister. The arming interface is versatile and may be employed on any number of launching platforms. The baseplates may be manually placed by an operator or placed via a vehicle either as a separate component or integral to the baseplate itself. The vehicle may be manned or unmanned (i.e. robotic) and may travel through any medium including space, air, ground, sub-terrain, surface water or underwater. The single-point munition arming interface may be used to arm any number of munitions which require removing a safety, locking and arming on any munition. Those skilled in the art will appreciate that the single-point munition arming interface described throughout may be modified to accommodate munitions with differing sizes and dimensions without deviating from the operating principles. In addition, new munitions may be made which employ the same breech thereby allowing for new capabilities without modification to the single-point munition arming interface.

The SAVO scalable mine deployment system comprises one or more remotely initiated baseplates. Each baseplate accommodates munition canisters which store munitions. For example, the munitions may be anti-vehicle munitions for creating a minefield. The one or more baseplates may be pre-deployed throughout an area in a desired pattern for a modular approach for achieving the desired effect of the minefield. The desired pattern may be chosen based on terrain, area of coverage and purpose of minefield. After placement, the munition canisters within each baseplate are armed by the single-point munition arming interface and the baseplates remain in place in an armed state until dispersal of the munitions is desired. A deploy command may be hardwired or remotely transmitted to the baseplates to deploy the munitions housed in their containers.

Figure 2:
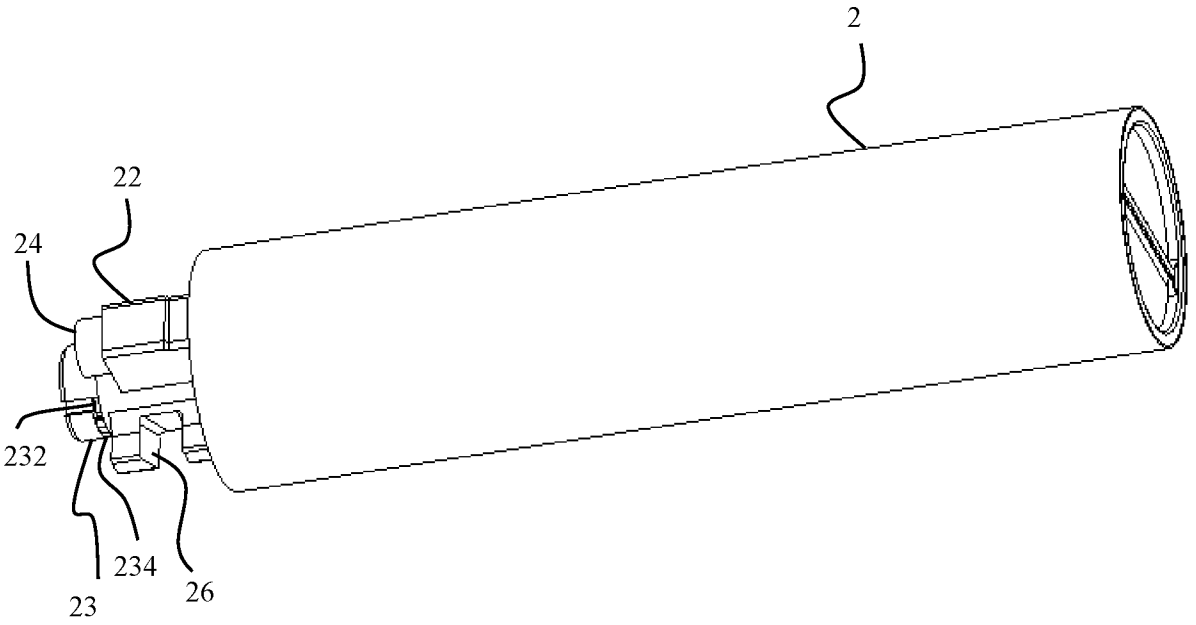
FIG. 2 shows a munition canister for a SAVO baseplate, according to an illustrative embodiment.

FIG. 1 shows a SAVO baseplate, according to an illustrative embodiment. FIG. 2 shows a munition canister for a SAVO baseplate, according to an illustrative embodiment. Each SAVO baseplate 1 accommodates a plurality of munition canisters 2. Each munition canister 2 houses one or more munitions for deployment. For example, in an embodiment, the munition canisters 2 are the same or similar in operation to those employed on the M87/M87A1 Volcano Multiple Delivery Mine system, each capable of holding six Volcano mines.

The munition canister further comprises a munition canister breech 22. The munition canister breech houses the munition canister safe and arm device. As will be described in more detail below, the single-point munition arming interface interacts with the munition canister safe and arm device to arm the munition canister 2. In the embodiment shown, the munition canister breech comprises a slider housing 23. The slider housing comprises a notch which provides access to a munition plunger 232, a first feature of the munition canister safe and arm device. Within the slider housing is a slider 234, a second feature of the munition canister safe and arm device. The slider 234 comprises a primer charge and is normally held out-of-line. The munition plunger 232 restricts movement to the inline position and must be disengaged before the slider 234 may be moved in-line. The munition breech further comprises an electrical connector 24 for electrical communication. Finally, the munition breech comprises a munition locking key 26 for securing the munition canister in place.

The munition canisters 2 are arranged symmetrically around the frame such that the recoil forces generated when ejecting mines is cancelled in the horizontal direction. By cancelling the horizontal component of recoil, the baseplate 1 position is secure throughout deployment. Each baseplate 1 provides for 360 degrees of coverage.

The baseplate 1 further comprises four baseplate arms 10 extending radially from the center. Each baseplate arm 10 houses a single-point munition arming interface within the arm. A housing opening 102 in each baseplate arm 10 allows the munition canister 2 to be inserted through and interface with the single-point munition arming interface. Each housing opening 102 is covered by a covering to shield it from the external environment when not in use. An arming lever 32 of the single-point munition arming interface extends beyond the housing of the baseplate 1 and is in contact with an external side surface of the baseplate arm 10.

Figure 3:
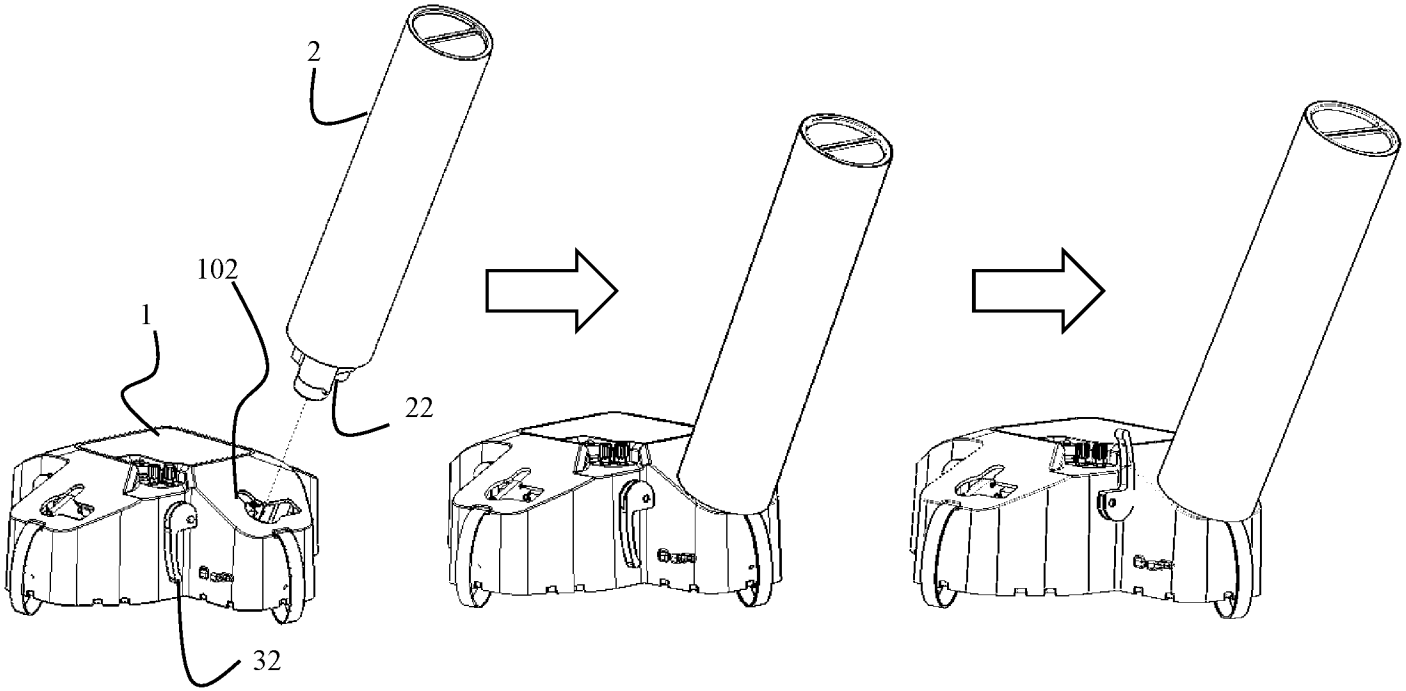
FIG. 3 is a flowchart which illustrates the operation of the single-point munition arming interface, according to an illustrative embodiment.

FIG. 3 is a flowchart which illustrates the operation of the single-point munition arming interface, according to an illustrative embodiment. To arm the munition canister 2, the user first inserts the munition canister 2 into a corresponding housing opening 102 defined by a face of the baseplate housing. The opening 102 is shaped such that the munition canister 2 may only be inserted in a correct orientation. The insertion of the munition canister 2 puts the munition canister breech 22 in contact with the single-point munition arming interface. Features on the single-point munition arming interface initiates the munition's safe and arm features upon insertion.

In addition, upon insertion of the munition canister 2, an electrical connection is made between the baseplate 1 and the munition canister 2 through electrical interfaces in the munition canister 2 and the single-point munition arming interface. The arming interface is positioned within the housing such that the electrical interface mates with the electrical connectors on the munition canister 2. The electrical connection allows the baseplate 1 to supply a proper voltage to the munition canister 2 and transmit and receive information to and from the munition canister 2. For example, a deploy command may be transmitted to the munition canister 2 through the electrical interface.

The arming lever 32 is then rotated to secure the munition canister 2 within the baseplate 1 and complete the arming of the munition. Rotation of the arming lever 32 further secures the munition canister 2 by locking it in place and provides enough force to create the appropriate pressure required for environmental sealing and mating of the electrical interface. In addition, the rotation of the arming lever 32, simultaneously arms the munition canister 2 by moving the slider 234 into the inline position, as will be described in further detail below.

For example, the M87/M87A1 Volcano munition canister safe and arm device is housed within the Volcano breech 22 and comprises a plunger 232 and a slider 234. A primer is housed within the slider 234. To arm the M87/M87A1 munition canister 2, the plunger 232 must first be depressed upward. As will be described further below, upon insertion of the munition canister breech 22 into the single-point munition arming interface, a retaining arm contacts the munition canister plunger 232 and moves the munition canister plunger 232 upwards. The munition canister plunger 232 serves as a lock by blocking the path of a munition canister slider 234. By depressing the plunger 232, the slider 234 is free to be moved into the inline position.

While the plunger 232 is depressed upward, the slider 234 must then be moved sideways to line the primer up with the pressure cartridge. The single-point munition arming interface simultaneously secures the munition canister 2 within the baseplate housing and moves the slider 234 sideways.

Figure 4:
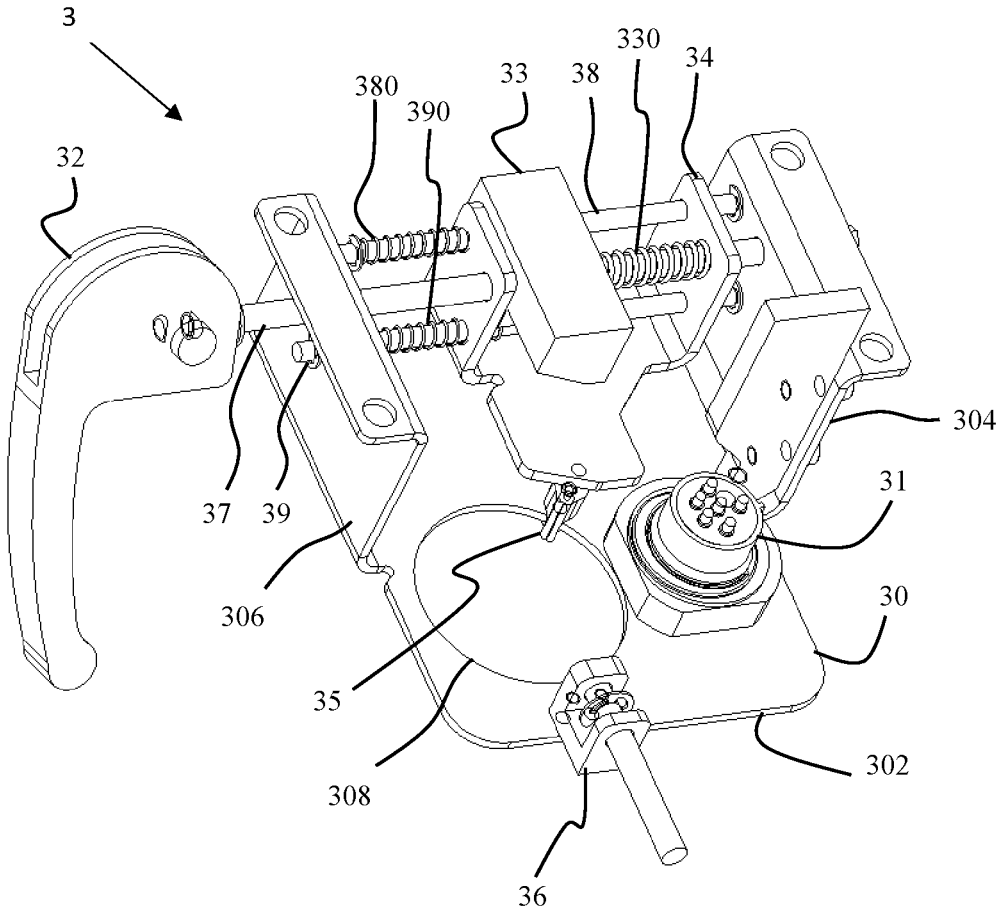
FIG. 4 is a perspective view of a single-point munition arming interface in an unarmed position, according to an illustrative embodiment.
Figure 5:
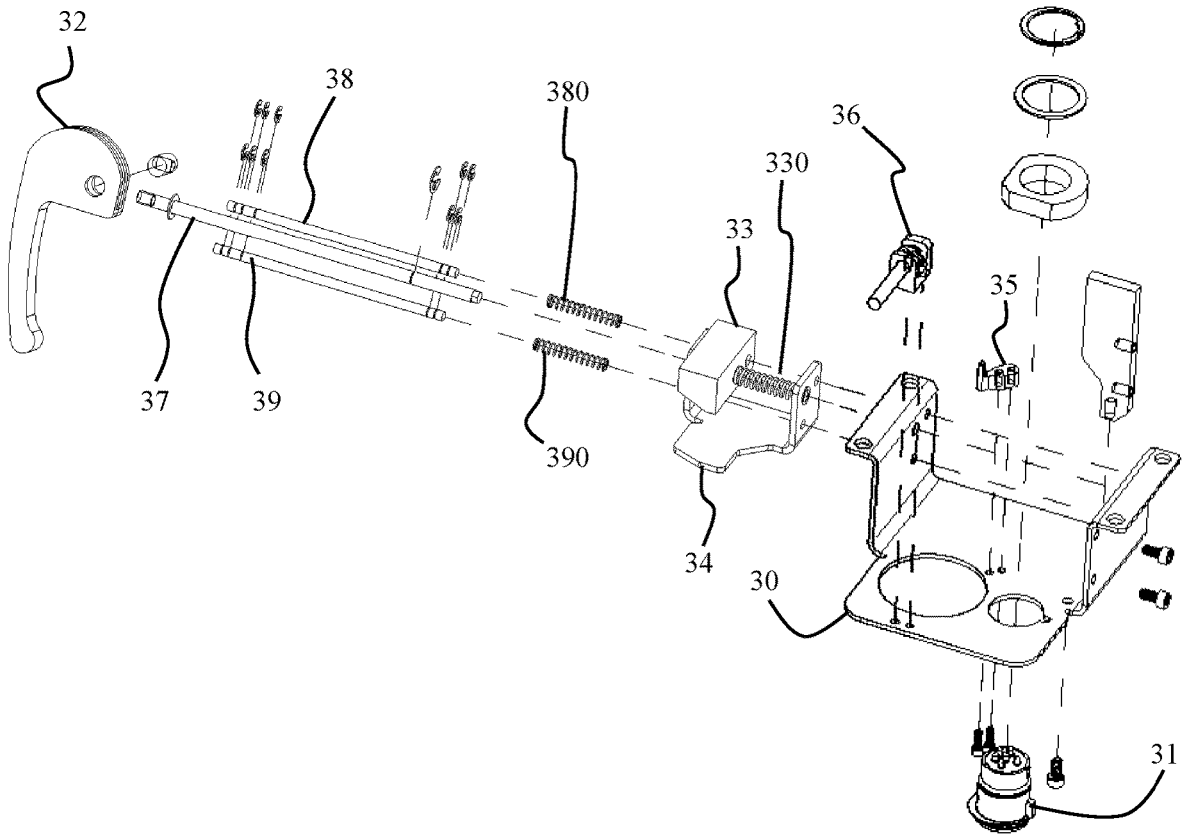
FIG. 5 is an exploded view of a single-point munition arming interface, according to an illustrative embodiment.

FIG. 4 is a perspective view of a single-point munition arming interface in an unarmed position, according to an illustrative embodiment. FIG. 5 is an exploded view of a single-point munition arming interface, according to an illustrative embodiment. The single-point munition arming interface 3 comprises a mounting bracket 30, an electrical interface 31, an arming lever 32, a locking lug 33, an arming plate 34, a retaining arm 35, a positive return assembly 36, a center rod 37, a first retention rod 38, a second retention rod 39, a lug spring 330, a first retention spring 380 and a second retention spring 390.

The mounting bracket 30 is mounted to a housing of a baseplate 1. For example, in the embodiment shown, the mounting bracket 30 is mounted within an arm of the SAVO baseplate 1 housing. The mounting bracket 30 serves as a mounting surface for components of the single-point munition arming interface 3. The mounting bracket 30 is roughly U-shaped with a flat bottom portion 302 and two arms 304, 306 extending in an upwards direction along a portion of the flat bottom portion 302.

The mounting bracket 30 further defines a circular-shaped opening 308 in the bottom of the mounting bracket 30 sized to receive the munition canister breech 22. The munition canister breech 22 is received within this circular opening 308 when inserted into the single-point munition arming interface 3.

The electrical interface 31 extends through the mounting bracket 30 bottom portion 302 proximate the circular opening 308. The electrical interface 31 is positioned on the mounting bracket 30 to mate with a corresponding electrical interface 24 on the munition canister 2. Electronic components within the SAVO baseplate 1 communicate with the munition canister 2 through the electrical interfaces 31 and 24.

Figure 6:
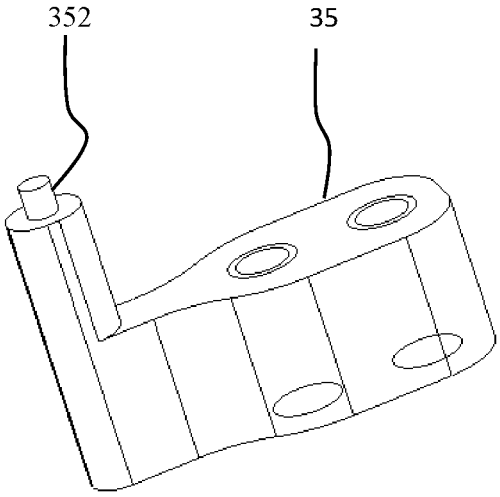
FIG. 6 is a perspective view of a retaining arm, according to an illustrative embodiment.

FIG. 6 is a perspective view of a retaining arm, according to an illustrative embodiment. The retaining arm 35 is positioned on the mounting bracket 30 and proximate the circular opening 308. The retaining arm 35 comprises a pin shaped protrusion 352 which is sized and dimensioned to disengage a first safety of the munition canister 2 upon insertion of the munition canister 2 into the single-point munition arming interface 3. For example, in an embodiment, the retaining arm 35 is sized and dimensioned to push a munition plunger 232 in the munition canister breech 22 in an upward direction.

Figure 7:
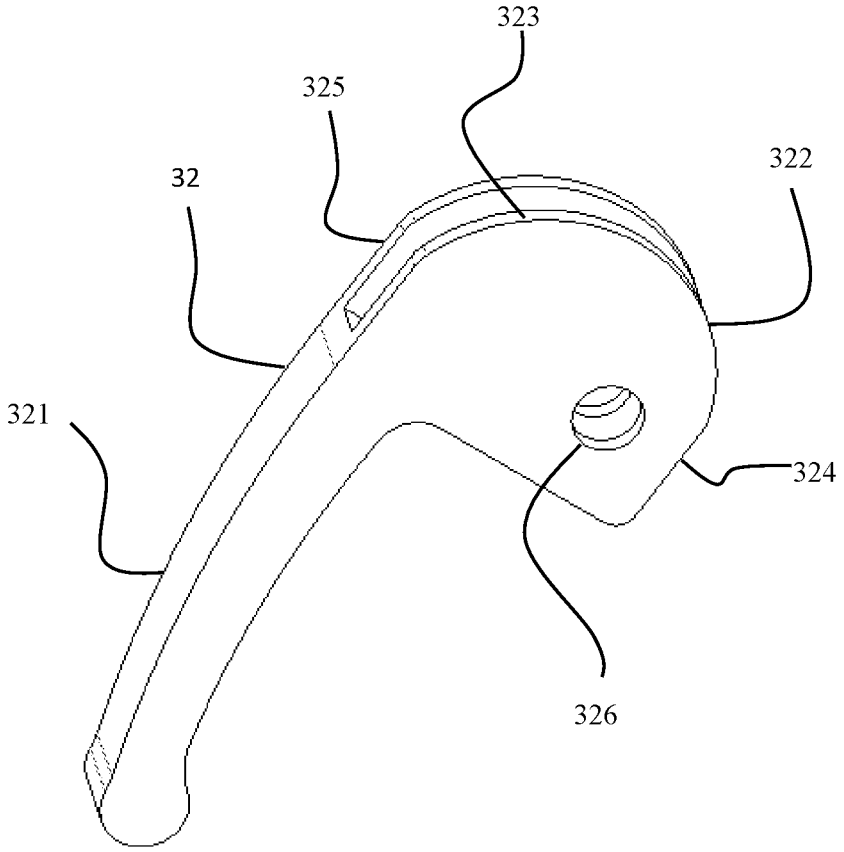
FIG. 7 is a perspective view of the arming lever, according to an illustrative embodiment.

FIG. 7 is a perspective view of the arming lever, according to an illustrative embodiment. A rotating arming lever 32 is connected to the mounting bracket 30 via a center rod 37 which extends from the arming lever 32 through each arm 304, 306 of the mounting bracket 30. The arming lever 32 comprises a handle portion 321 and a main body 322. The main body 322 further comprises a cammed surface 323 between a first flat surface 324 and a second flat surface 325. The cammed surface 323 interfaces with an exterior surface of the SAVO baseplate 1. As will be described further below, the rotation of the arming lever 32 as directed by the cammed surface 323 controls the operation of the single-point munition arming interface 3.

The center rod 37 is connected to the body 322 of the arming lever 32 via a hinged joint which extends through a hole 326 in the body 322. The body 322 of the arming lever 32 defines a partially enclosed hollow space thereby allowing the arming lever 32 to rotate around the center rod 37. The center rod 37 is free to translate axially within the single-point munition arming interface. Rotation of the arming lever 32 clockwise and counterclockwise causes the center rod 37 to translate axially toward and away from the arming lever 32, respectively.

Figure 8:
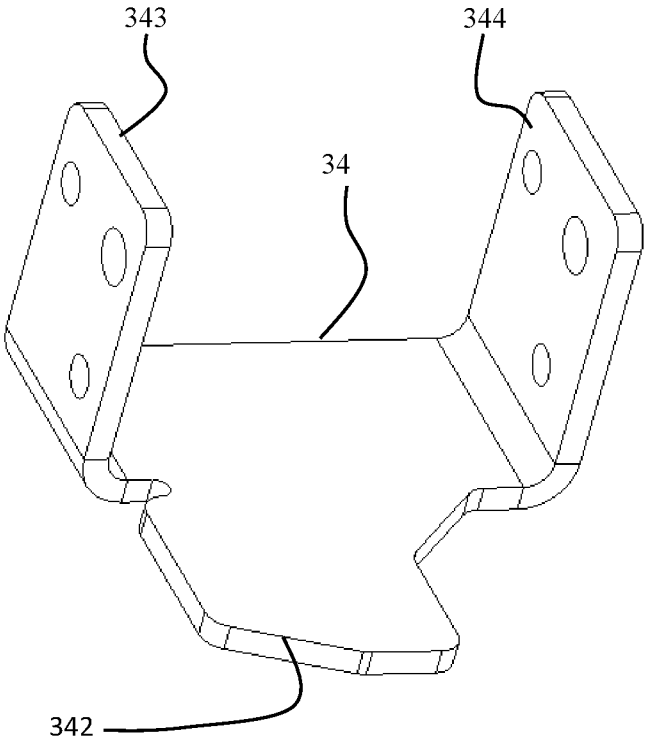
FIG. 8 is a perspective view of an arming plate, according to an illustrative embodiment.

FIG. 8 is a perspective view of an arming plate, according to an illustrative embodiment. The arming plate 34 is a U-shaped component positioned between the two arms 304, 306 of the mounting bracket 30. The center rod 37 extends through opposing holes in the arms 343, 344 of the arming plate 34 thereby supporting the arming plate 34 within the mounting bracket 30. The arming plate 34 is further supported between the arms 304, 306 of the mounting bracket 30 by two retention rods 38, 39. The retention rods 38, 39 are fixed between the interior surfaces of the mounting bracket arms 304, 306 and extend through both arms 343, 344 of the arming plate 34. The rearmost retention rod, the first retention rod 38, is positioned higher in the single-point munition arming interface 3.

Refer back to FIG. 4. A retaining ring is positioned on each retention rod 38, 39 proximate to the interior surface of the mounting bracket arm 306 that is closer to the arming lever 32. A retention spring 380, 390 surrounds a portion of each retention rod 38, 39 between the retaining ring and an arming plate 34. The retention spring 380, 390 is in compression between the retaining ring and the arming plate 34 and serves to hold the arming lever 32 against the SAVO baseplate 1 thereby maintaining the arming lever 32, center rod 37 and arming plate 34 in the correct positions within the single-point munition arming interface.

The arming plate 34 moves axially with the center rod 37. Accordingly, clockwise and counterclockwise rotation of the arming lever 32 causes axial movement of the arming plate 34 toward and away from the arming lever 32, respectively. Axial movement of the arming plate 34 toward the arming lever 32 further compresses each retention spring 380, 390.

An interface portion 342 of the bottom of the arming plate 34 is sized and dimensioned to interface with an arming feature of the munition canister 2. For example, in the embodiment shown, the interface portion is a relatively thin plate sized and dimensioned to interact with a slider 234 of the munition canister 2. As the arming plate 34 translates axially toward the arming lever 32, the interface portion 342 is received within the munition canister breech 22 and moves the slider 234 such that the primer is in line within the munition canister 2 thereby arming the munition.

Figure 9:
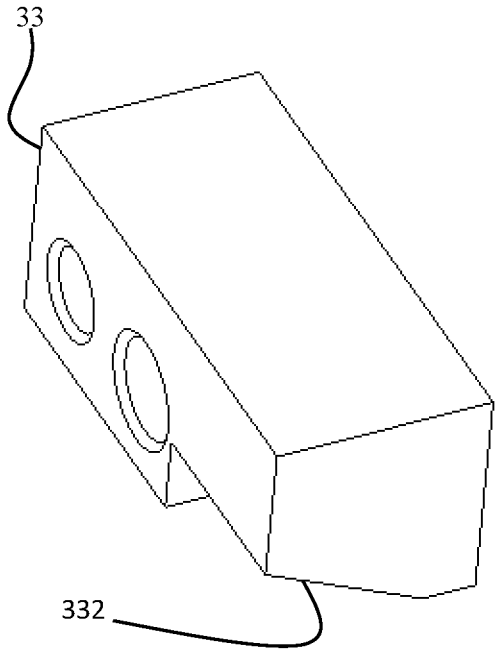
FIG. 9 is a perspective view of a locking lug, according to an illustrative embodiment.

FIG. 9 is a perspective view of a locking lug, according to an illustrative embodiment. The locking lug 33 interfaces with a locking key 26 of the munition canister 2 to further position the munition canister 2 and lock the munition canister 2 in place. In addition, the locking force creates the appropriate pressure required for environmental sealing and mating of the electrical interface. The locking lug 33 is positioned between arms of the arming plate 34. The first retention rod 38 and the center rod 37 extend through holes in the locking lug 33 such that the locking lug 33 is free to axially slide along the rods.

An interacting surface 332 of the locking lug 33 is shaped to push the munition canister 2 in place by interfacing with a corresponding munition canister locking key 26 of the munition canister 2. For example, in the embodiment shown, the slanted surface 332 forces the munition canister 2 downward as the locking lug 33 translates toward it.

A lug spring 330 is positioned around the center rod 37 between the locking lug 33 and the arming plate arm 344 distal the arming lever 32. The lug spring 330 is in compression between the locking lug 33 and the arming plate arm 344 thereby pushing the locking lug 33 in a direction toward the arming lever 32 and against the munition canister 2. The lug spring 330 is strong enough to hold the munition canister 2 upright and against the mounting bracket 30. For example, a Volcano munition canister 2 weighs approximately 30 pounds thereby requiring a spring with a relatively strong strength.

Figure 10:
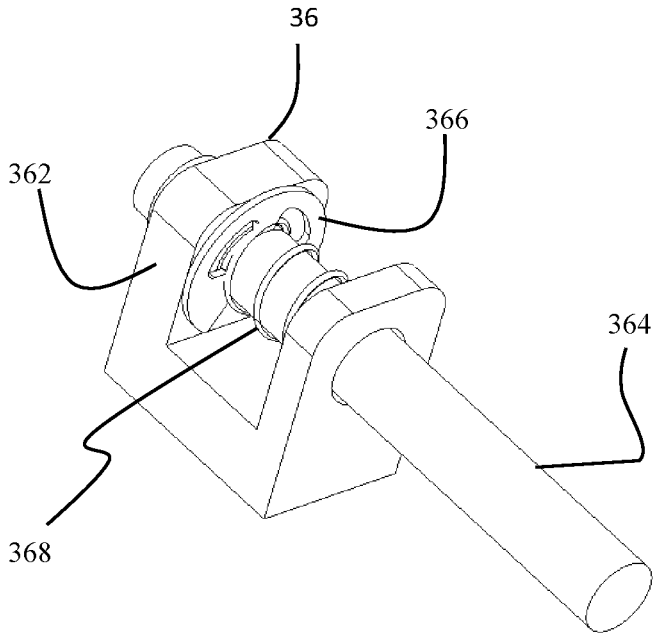
FIG. 10 is a perspective view of a positive return assembly, according to an illustrative embodiment.

FIG. 10 is a perspective view of a positive return assembly, according to an illustrative embodiment. A benefit of the SAVO system is that munition canisters 2 which are armed but never deployed may be unarmed and reused. However, it is hazardous if an arming lever 32 is returned to an unarmed state but the munition canister 2 does not revert to the unarmed state. This may not be recognized by the user as there may be no indication on the munition canister 2 of the status of the munition canister 2.

Certain munition canisters 2 may be more susceptible to this condition as they are intended to be left in an armed state in the field for extended periods of time. During this time, internal mechanisms within the munition canister 2, such as springs, may be held in an activated state for a prolonged period of time and may not return to the inactivated state.

The positive return assembly 36 provides both an indicator of the armed status of the munition canister 2 and a means for returning the slider 234 into the unarmed position. The positive return assembly 36 comprises a yoke 362, a shaft 364, a retaining ring 366 and a spring 368.

The yoke 362 is connected to the mounting bracket 30 and supports the shaft 364 within the yoke 362. The shaft 364 is free to translate axially within the yoke 362. However, the retaining ring 366, positioned with the two arms of the yoke 362 restricts the shaft 364 from moving too far axially toward the munition canister 2. The spring 368 is positioned between the retaining ring 366 and a second arm of the yoke 362. Axial movement of the shaft 364 away from the munition canister 2 compresses the spring 368.

A proximate end of the shaft 364 is in contact with a slider 234 such that when the slider 234 is moved in an armed state the shaft is pushed away from the munition canister 2. This extended position of the shaft 364 provides an indication that the munition canister 2 is in an armed state. During recovery operation, as the arming lever 32 is returned to an unarmed state, the slider 234 should return as well thereby allowing the shaft to translate toward the munition canister 2 under the force of the spring. However, in instances where the slider 234 does not automatically return, for example, if the slider 234 spring is not functioning correctly, the extended shaft 364 will give an indication that the munition canister 2 is still in an armed state. A push on the distal end of the shaft 364 will provide a means to provide a force on the slider 234 to return to the unarmed state.

While the positive return assembly 36 shown in FIG. 10 provides on embodiment for returning the munition canister 2 to an unarmed state, it is not the only embodiment. In an alternative embodiment, the arming plate 34 may comprise an additional feature opposite the interface portion 342 which would serve to return the slider 234 of the munition canister as the arming plate 34 translates axially away from the arming lever 32.

Figure 11:
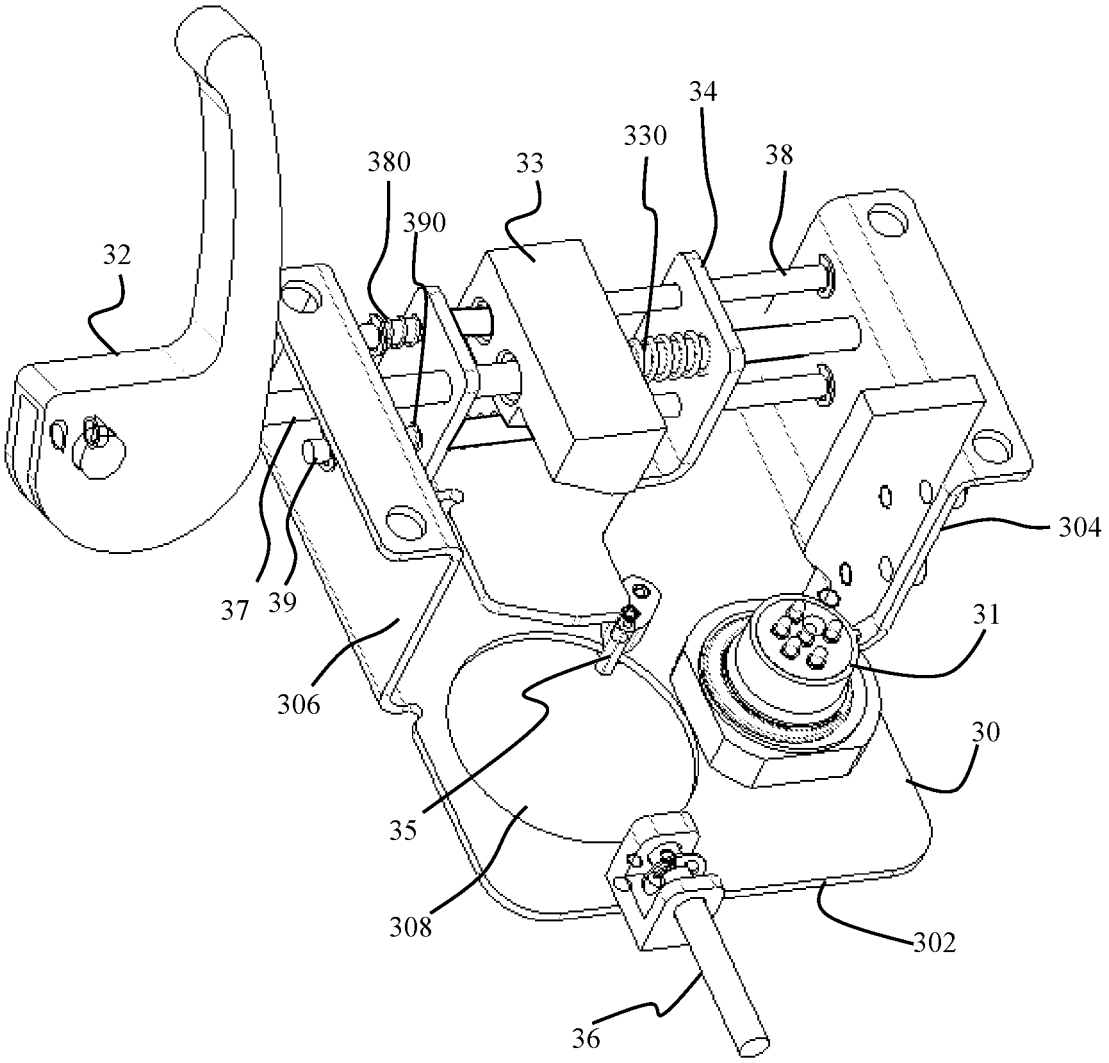
FIG. 11 is a perspective view of a single-point munition arming interface in an armed position, according to an illustrative embodiment.

FIG. 11 is a perspective view of a single-point munition arming interface in an armed position, according to an illustrative embodiment. The single-point munition arming interface 3 is actuated by a rotation of the arming lever 32 from the unarmed position shown in FIG. 4 to the armed position shown in FIG. 11. In the embodiment shown, the arming lever 32 is rotated 180 degrees in a clockwise position such that the distal end of the arming lever 32 is rotated from facing downward to facing upward.

In the unarmed position a first flat outer surface 324 of the arm lever body 322 is in contact with the outer surface of the baseplate 1. In the armed position, a second flat outer surface 325 of the body 322, opposite the first flat outer surface 324 of the body 322, is in contact with the outer surface of the baseplate 1. In between the two, the cammed surface 323 of the arming lever body 322 travels along the outer surface of the baseplate 1. In both the armed and unarmed position, as well as the transition between the two, the retention springs 380, 390 maintain this position by pulling the arming lever 32 toward the baseplate 1. The flat profiles of the first flat surface 324 and the second flat surface 325, in combination with the force of the retention springs 380, 390, provide stability to both the armed and unarmed positions ensuring that the single-point munition arming interface 3 will not be inadvertently knocked out of these states.

The rotation of the arming lever 32 causes the center rod 37 to be pulled toward the arming lever 32. The center rod's 37 axial translation toward the arming lever 32 causes both the arming plate 34 and the locking lug 33 to also be simultaneously pulled toward the arming lever 32.

The locking lug 33 interfaces with a locking key 26 on the munition canister 2 to lock the munition canister 2 in place. The locking lug 33 rides on the lug spring 330 that is compressed once the locking lug 33 makes contact with the canister locking key 26 thus creating the appropriate pressure required for environmental sealing and mating of the electrical interface 31.

The interface portion 342 of the arming plate 34 interfaces with a slider 234 in the munition canister 2 to arm the munition. The arming plate 34 contacts the munition slider 234 to push the primer in line with the pressure cartridge, thereby resulting in an armed munition canister 2.

Figure 12:
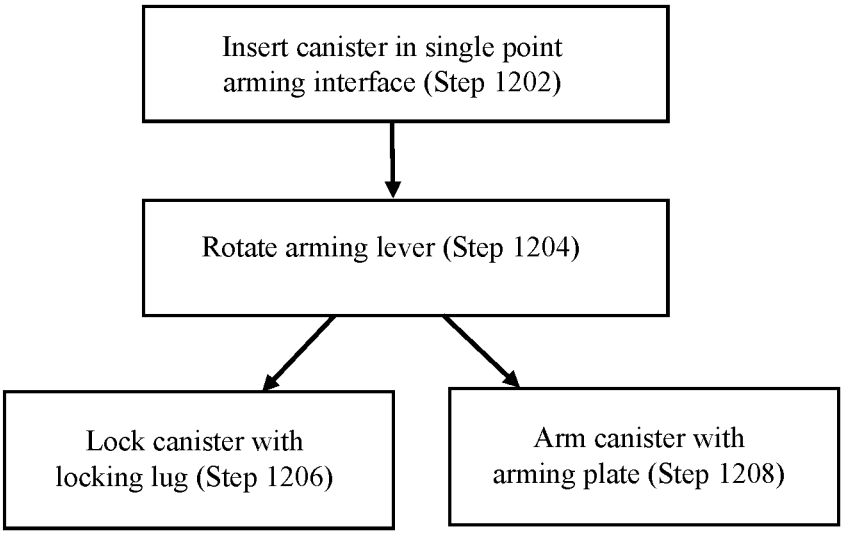
FIG. 12 is a flow chart illustrating the actions for operating the single-point munition arming interface, according to an illustrative embodiment.

FIG. 12 is a flow chart illustrating the actions for operating the single-point munition arming interface, according to an illustrative embodiment.

In step 1202, a munition canister 2 is inserted into the single-point munition arming interface 3. For example, the munition canister 2 may be inserted through an opening 102 in a housing in which the single-point munition arming interface 3 is housed. The munition canister breech 22 of the munition canister 2 is received in an opening 308 in the mounting bracket 30 of the single-point munition arming interface 3. An electrical connection is made via an electrical interface 31.

In addition, the insertion of the munition canister 2 causes the safety, the munition plunger 232, of the munition canister 2 to be depressed.

In step 1204, the single-point munition arming interface 3 is actuated by a rotation of the arming lever 32 from the unarmed position to the armed position. The rotation of the arming lever 32 is done by rotating the arming lever 180 degrees clockwise such that the arming lever 32 transitions from having a first flat surface 324 in contact with the housing to having a second opposed flat surface 325 in contact with the housing via a cammed surface 323.

In step 1206, the locking lug 33 engages the canister locking key 26 to lock the munition canister 2 in place.

In step 1208, simultaneous with step 1206, the arming plate 34 engages a slider 234 in the munition canister 2.

While the invention has been described with reference to certain embodiments, numerous changes, alterations and modifications to the described embodiments are possible without departing from the spirit and scope of the invention as defined in the appended claims, and equivalents thereof.

What is claimed is:

1. A single-point munition arming interface for safeing and arming a munition canister, the single-point munition arming interface comprising:

a mounting bracket having a first mounting bracket arm and a second mounting bracket arm and defining an opening for receiving a breech of a munition canister;

an electrical interface mounted through the mounting bracket for making an electrical connection with the munition canister;

a retaining arm for interfacing with a munition plunger of a canister safe and arm device; and a center rod vertically supported by but axially unrestrained by the first mounting bracket arm and the second mounting bracket arm;

an arming lever hingedly connected to a proximate end of the center rod such that a rotation of the arming lever causes the center rod to translate axially;

an arming plate further comprising a base, a first arming plate arm and a second arming plate arm and positioned between the first arm and the second arm of the mounting bracket with the center rod extending through the first arming plate arm and the second arming plate arm;

a locking lug sized and dimensioned to interface with a canister locking key and positioned slidably on the center rod between the first arming plate arm and the second arming plate arm;

a lug spring surrounding the center rod between the locking lug and the second arming plate arm; and wherein a rotation of the arming lever causes the center rod to translate axially toward the arming lever thereby simultaneously causing the arming plate and the locking lug to translate axially toward the arming lever and the locking lug interacting with a locking key on a canister and the arming mechanism interacting with a slider of the canister safe and arm device.

2. The single-point munition arming interface of claim 1 further comprising a first retention rod and a second retention rod disposed between first mounting bracket arm and a second mounting bracket arm, said first retention rod and second retention rod being partially encircled by a spring between the first mounting bracket arm and the arming plate and serving to position the single-point munition arming interface within a housing.

3. The single-point munition arming interface of claim 1 wherein the single-point munition interface is disposed within a munition baseplate housing with the arming lever extending through the housing.

4. The single-point munition arming interface of claim 3 wherein the munition baseplate is a Standoff Activated Volcano Obstacle (SAVO) baseplate.

5. The single-point munition arming interface of claim 4 wherein the munition canister is a Volcano munition canister.

6. The single-point munition arming interface of claim 1 wherein the arming plate further comprises an interface portion sized and dimensioned to be inserted into a canister munition to move a slider to an inline armed position.

7. The single-point munition arming interface of claim 1 further comprising a positive return assembly, said position return assembly further comprising an indicator shaft for providing both an indicator of the canister munition state and returning a slider to an out-of-line unarmed position.

8. The single-point munition arming interface of claim 7 wherein the positive return assembly further comprises a yoke mounted on the mounting bracket and supporting the shaft and a compression spring encircling a portion of the shaft between a pair of yoke arms.

9. A single-point munition arming interface for safeing and arming a munition, the single-point munition arming interface comprising:

a mounting bracket defining an opening for receiving a breech of a munition;

a retaining arm for interfacing with a first safe feature of a munition safe and arm device upon insertion of the munition into the single-point munition arming interface; and a locking and arming mechanism operated by an arming lever to simultaneously secure the munition within the single-point munition arming interface and arm the munition by positioning a munition primer to an in-line position.

10. The single-point munition arming interface of claim 9 wherein the locking and arming mechanism comprises an arming plate further comprising a base, a first arming plate arm and a second arming plate arm wherein the base comprises an interface portion sized and dimensioned to interact with a slider of the munition safe and arm device to position a munition primer to an in-line position.

11. The single-point munition arming interface of claim 10 wherein the locking and arming mechanism comprises a locking lug configured to secure the munition within the single-point munition arming interface by interfacing with a munition locking key, said locking lug sized and dimensioned to interface with a munition locking key.

12. The single-point munition arming interface of claim 11 wherein a rotation of the arming lever simultaneously causes the arming plate and the locking lug to translate axially toward the arming lever and the locking lug interacting with a locking key on the munition and the arming mechanism interacting with a slider of the munition safe and arm device.

13. The single-point munition arming interface of claim 12 further comprising a center rod vertically supported by but axially unrestrained by the first mounting bracket arm and the second mounting bracket arm and wherein:

the arming lever is hingedly connected to a proximate end of the center rod such that a rotation of the arming lever causes the center rod to translate axially;

the arming plate is positioned between the first arm and the second arm of the mounting bracket with the center rod extending through a first arming plate arm and a second arming plate arm;

the locking lug is positioned slidably on the center rod between the first arming plate arm and the second arming plate arm;

a lug spring surrounds the center rod between the locking lug and the second arming plate arm; and wherein a rotation of the arming lever causes the center rod to translate axially toward the arming lever thereby simultaneously causing the arming plate and the locking lug to translate axially toward the arming lever.

14. The single-point munition arming interface of claim 10 further comprising a first retention rod and a second retention rod disposed between first mounting bracket arm and a second mounting bracket arm, said first retention rod and second retention rod being partially encircled by a spring between the first mounting bracket arm and the arming plate and serving to position the single-point munition arming interface within a housing.

15. The single-point munition arming interface of claim 10 wherein the single-point munition interface is disposed within a Standoff Activated Volcano Obstacle (SAVO) baseplate housing with the arming lever extending through the Standoff Activated Volcano Obstacle (SAVO) baseplate housing.

16. The single-point munition arming interface of claim 9 wherein the retaining arm is sized and dimensioned to push a munition plunger in an upward direction upon insertion of the munition into the single-point munition arming interface.

17. The single-point munition arming interface of claim 9 further comprising an electrical interface mounted through the mounting bracket for making an electrical connection with the munition.

18. The single-point munition arming interface of claim 9 further comprising a positive return assembly, said position return assembly further comprising an indicator shaft for providing both an indicator of an armed state of the munition and returning the munition primer to an out-of-line position.

19. The single-point munition arming interface of claim 18 wherein the positive return assembly further comprises a yoke mounted on the mounting bracket and supporting the shaft and a compression spring encircling a portion of the shaft between a pair of yoke arms.

* * * * *